US008386271B2

(12) United States Patent
Koishida et al.

(10) Patent No.: US 8,386,271 B2
(45) Date of Patent: Feb. 26, 2013

(54) LOSSLESS AND NEAR LOSSLESS SCALABLE AUDIO CODEC

(75) Inventors: Kazuhito Koishida, Redmond, WA (US); Sanjeev Mehrotra, Kirkland, WA (US); Radhika Jandhyala, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1261 days.

(21) Appl. No.: 12/055,223

(22) Filed: Mar. 25, 2008

(65) Prior Publication Data

US 2009/0248424 A1 Oct. 1, 2009

(51) Int. Cl.
*G10L 21/04* (2006.01)

(52) U.S. Cl. ..... 704/503; 704/500; 704/229

(58) Field of Classification Search ..... 704/500, 704/229, 503

See application file for complete search history.

(56) References Cited

U.S. PATENT DOCUMENTS

| | | | | |
|---|---|---|---|---|
| 5,063,574 | A | 11/1991 | Moose | |
| 5,361,278 | A | 11/1994 | Vaupel et al. | |
| 5,557,298 | A | 9/1996 | Yang et al. | |
| 5,839,100 | A | 11/1998 | Wegener | |
| 5,857,000 | A | 1/1999 | Jar-Ferr et al. | |
| 5,884,269 | A | 3/1999 | Cellier et al. | |
| 5,914,987 | A | 6/1999 | Fogel | |
| 5,926,611 | A | 7/1999 | Yang et al. | |
| 6,029,126 | A | 2/2000 | Malvar | |
| 6,092,041 | A * | 7/2000 | Pan et al. | 704/229 |
| 6,121,904 | A | 9/2000 | Levine | |
| 6,141,446 | A | 10/2000 | Boliek et al. | |
| 6,141,645 | A | 10/2000 | Chi-Min et al. | |
| 6,219,458 | B1 | 4/2001 | Zandi et al. | |
| 6,493,338 | B1 | 12/2002 | Preston et al. | |
| 6,664,913 | B1 | 12/2003 | Craven et al. | |
| 6,675,148 | B2 | 1/2004 | Hardwick | |
| 6,757,437 | B1 | 6/2004 | Keith et al. | |
| 6,934,677 | B2 | 8/2005 | Chen et al. | |
| 7,027,982 | B2 | 4/2006 | Chen et al. | |
| 7,076,104 | B1 | 7/2006 | Keith et al. | |
| 7,133,832 | B2 | 11/2006 | Heo | |
| 7,146,313 | B2 | 12/2006 | Chen et al. | |

(Continued)

FOREIGN PATENT DOCUMENTS

| | | |
|---|---|---|
| JP | 11-509388 | 8/1999 |
| JP | 2000-232366 | 8/2000 |

(Continued)

OTHER PUBLICATIONS

Li et al., "Perceptually Layered Scalable Codec," *40th Asilomar Conference on Signals, Systems and Computers*, 2006, pp. 2125-2129.

(Continued)

*Primary Examiner* — Jakieda Jackson
(74) *Attorney, Agent, or Firm* — Klarquist Sparkman, LLP

(57) ABSTRACT

A scalable audio codec encodes an input audio signal as a base layer at a high compression ratio and one or more residual signals as an enhancement layer of a compressed bitstream, which permits a lossless or near lossless reconstruction of the input audio signal at decoding. The scalable audio codec uses perceptual transform coding to encode the base layer. The residual is calculated in a transform domain, which includes a frequency and possibly also multi-channel transform of the input audio. For lossless reconstruction, the frequency and multi-channel transforms are reversible.

19 Claims, 9 Drawing Sheets

U.S. PATENT DOCUMENTS

| | | | | |
|---|---|---|---|---|
| 7,225,136 | B2 | 5/2007 | Bruekers | |
| 7,240,001 | B2 | 7/2007 | Chen et al. | |
| 7,272,567 | B2 | 9/2007 | Fejzo | |
| 7,277,849 | B2 * | 10/2007 | Streich et al. | 704/229 |
| 7,953,595 | B2 * | 5/2011 | Xie et al. | 704/200.1 |
| 2002/0035470 | A1 | 3/2002 | Gao | |
| 2003/0012431 | A1 | 1/2003 | Irvine et al. | |
| 2003/0142874 | A1 | 7/2003 | Schwartz | |
| 2004/0044534 | A1 | 3/2004 | Chen et al. | |
| 2004/0102963 | A1 | 5/2004 | Li | |
| 2004/0184537 | A1 * | 9/2004 | Geiger et al. | 375/240.11 |
| 2005/0159940 | A1 | 7/2005 | Wu et al. | |
| 2006/0165302 | A1 * | 7/2006 | Han et al. | 382/240 |
| 2007/0016427 | A1 | 1/2007 | Thumpudi et al. | |
| 2007/0043575 | A1 | 2/2007 | Onuma et al. | |
| 2007/0063877 | A1 * | 3/2007 | Shmunk et al. | 341/50 |
| 2007/0121723 | A1 * | 5/2007 | Mathew et al. | 375/240.12 |
| 2007/0208557 | A1 | 9/2007 | Li et al. | |
| 2007/0274383 | A1 * | 11/2007 | Yu et al. | 375/240.11 |

FOREIGN PATENT DOCUMENTS

| | | |
|---|---|---|
| JP | 2002-041097 | 2/2002 |
| WO | WO01/26095 | 4/2001 |

OTHER PUBLICATIONS

Moriya et al., "A Design of Lossy and Lossless Scalable Audio Coding," *IEEE International Conference on Acoustics, Speech, and Signal Processing*, 2000, vol. 2, pp. 889-892.

"Windows Media Audio Codec," © 2007 Microsoft Corporation, 2 pp.

Bosi et al., "ISO/IEC MPEG-2 Advanced Audio Coding," *Journal of the Audio Engineering Society, Audio Engineering Society*, New York, pp. 789-812 (Oct. 1997).

Edler, "Coding of Audio Signals with Overlapping Block Transform and Adaptive Window Functions," *FREQUENZ, Schiele and Schon GMBH*, Berlin, Germany, pp. 252-256 (Sep. 1989). [also cited as: Edler, "Codierung Von Audiosignalen Mit Uberlappender Transformation Und Adaptiven Fensterfunktionen," ].

European Patent Office Official Communication dated Apr. 11, 2005, 8 pages.

European Patent Office Official Communication dated Aug. 31, 2006, 6 pages.

Golomb, "Run Length Encodings," *IEEE Transactions on Information Theory*, pp. 399-401 (Jul. 1996).

Hans et al., "Lossless Compression of Digital Audio," *IEEE Signal Processing Magazine*, vol. 18, No. 4, pp. 21-32 (Jul. 2001).

Kim and Li, "Lossless and lossy image compression using biorthogonal wavelet transforms with multiplierless operations," IEEE Transactions on Circuits and Systems—II: Analog and Digital Signal Processing 45(8):1113-1118, Aug. 1998.

Kofidis et al., "Wavelet-based medical image compression," *Future Generations Computer Systems, Elsevier Science Publishers*, vol. 15, No. 2, pp. 223-243 (Mar. 1999).

Liebchen et al., "Lossless Transform Coding of Audio Signals," *Lossless to Transparent Coding IEEE Signal Processing Workshop*, AES Convention, pp. 1-10 (1997).

Moriya et al., "Sampling rate scalable lossless audio coding," IEEE Workshop Proceedings, pp. 123-125, Oct. 6-9, 2002.

Sullivan et al., "The H.264/AVC Advanced Video Coding Standard: Overview and Introduction to the Fidelity Range Extensions," 21 pp. (Aug. 2004).

Yea and Pearlman, "A wavelett-based two-stage near-lossless coder," IEEE, 2004 International Conference on Image Processing (ICIP), pp. 2503-2506, 2004.

Office Action dated Jan. 22, 2010, for related Japanese Patent Application No. 2003-310669, 3 pages (English translation).

* cited by examiner

LOSSLESS AND NEAR LOSSLESS SCALABLE AUDIO CODEC

BACKGROUND

With the introduction of portable digital media players, the compact disk for music storage and audio delivery over the Internet, it is now common to store, buy and distribute music and other audio content in digital audio formats. The digital audio formats empower people to enjoy having hundreds or thousands of music songs available on their personal computers (PCs) or portable media players.

One benefit of digital audio formats is that a proper bit-rate (compression ratio) can be selected according to given constraints, e.g., file size and audio quality. On the other hand, one particular bit-rate is not able to cover all scenarios of audio applications. For instance, higher bit-rates may not be suitable for portable devices due to limited storage capacity. By contrast, higher bit-rates are better suited for high quality sound reproduction desired by audiophiles.

To cover a wide range of scenarios, scalable coding techniques are often useful. Typical scalable coding techniques produce a base bitstream with a high compression ratio, which is embedded within a low compression ratio bitstream. With such scalable coding bitstream, conversion from one compression ratio to another can be done quickly by extracting a subset of the compressed bitstream with a desired compression ratio.

Perceptual Transform Coding

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

For example, transform coding is conventionally known as an efficient scheme for the compression of audio signals. In transform coding, a block of the input audio samples is transformed (e.g., via the Modified Discrete Cosine Transform or MDCT, which is the most widely used), processed, and quantized. The quantization of the transformed coefficients is performed based on the perceptual importance (e.g. masking effects and frequency sensitivity of human hearing), such as via a scalar quantizer.

When a scalar quantizer is used, the importance is mapped to relative weighting, and the quantizer resolution (step size) for each coefficient is derived from its weight and the global resolution. The global resolution can be determined from target quality, bit rate, etc. For a given step size, each coefficient is quantized into a level which is zero or non-zero integer value.

At lower bitrates, there are typically a lot more zero level coefficients than non-zero level coefficients. They can be coded with great efficiency using run-length coding, which may be combined with an entropy coding scheme such as Huffman coding.

SUMMARY

The following Detailed Description concerns various audio encoding/decoding techniques and tools for a scalable audio encoder/decoder (codec) that provide encoding/decoding of a scalable audio bitstream including up to lossless or near-lossless quality.

In basic form, an encoder encodes input audio using perceptual transform coding, and packs the resulting compressed bits into a base layer of a compressed bitstream. The encoder further performs at least partial decoding of the base layer compressed bits, and further computes residual coefficients from the partially reconstructed base coefficients. The encoder also encodes the residual coefficients into an enhancement layer of the compressed bitstream. Such residual coding can be repeated any number of times to produce any number of enhancement layers of coded residuals to provide a desired number of steps scaling the audio bitstream size and quality. At the decoder, a reduced quality audio can be reconstructed by decoding the base layer. The one or more enhancement layers also may be decoded to reconstruct residual coefficients to improve the audio reconstruction up to lossless or near lossless quality.

In lossless versions of the scalable codec, the encoder performs partial reconstruction of the base coefficients with integer operations. The encoder subtracts these partially reconstructed base coefficients from reversible-transformed coefficients of the original audio to form residual coefficients for encoding as the enhancement layer. At the decoder, a lossless reconstruction of the audio is achieved by performing partial reconstruction of the base coefficients as an integer operation, adding the base coefficients to residual coefficients decoded from the enhancement layer, and applying the inverse reversible transform to produce the lossless output.

A near lossless scalable codec version is accomplished by substituting low complexity non-reversible operations that closely approximated the reversible transform of the lossless scalable codec version. Further a low complexity near lossless decoder can be used to decode the compressed bitstream produced with a lossless version scalable codec encoder. For example, a near lossless scalable decoder may replace the reversible implementation of the Modulated Lapped Transform (MLT) and reversible channel transform of the lossless encoder with non-reversible transforms.

For multi-channel scalable codec versions, the encoder encodes the base coefficients for multiple channels of audio using a channel transform. But, the encoder computes the residual in the non-channel transformed domain. The encoder also encodes the residual coefficients using a channel transform for better compression.

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
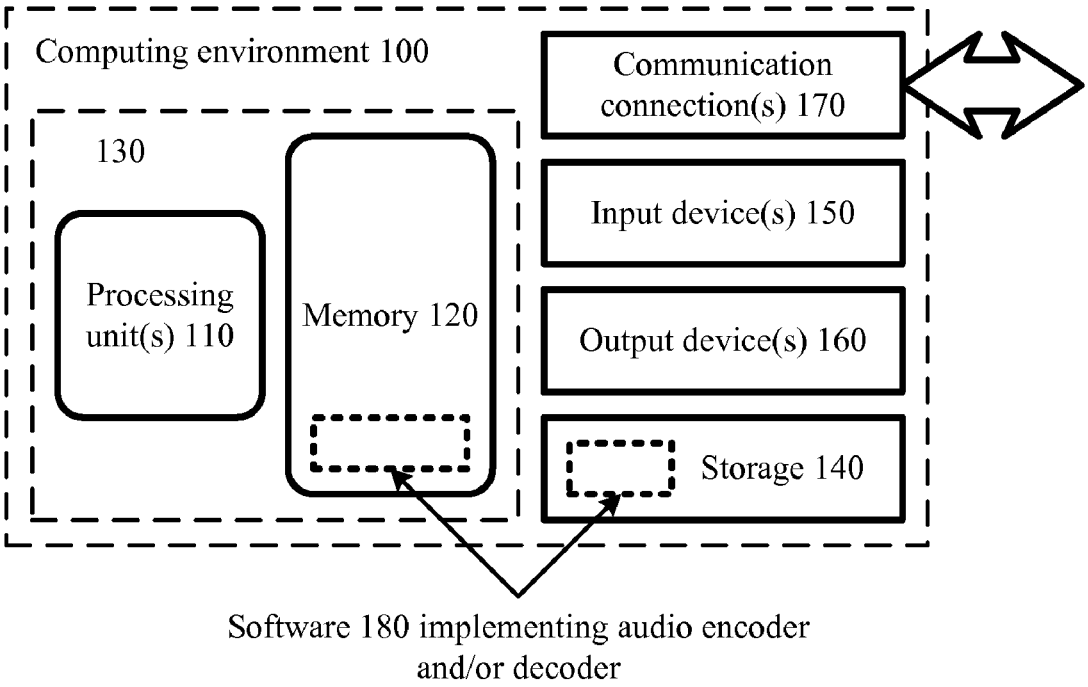
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The processing unit also can comprise a central processing unit and co-processors, and/or dedicated or special purpose processing units (e.g., an audio processor). The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touchscreen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication over a communication medium to one or more other computing entities. The communication medium conveys information such as computer-executable instructions, audio or video information, or other data in a data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable media include memory 120, storage 140, communication media, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
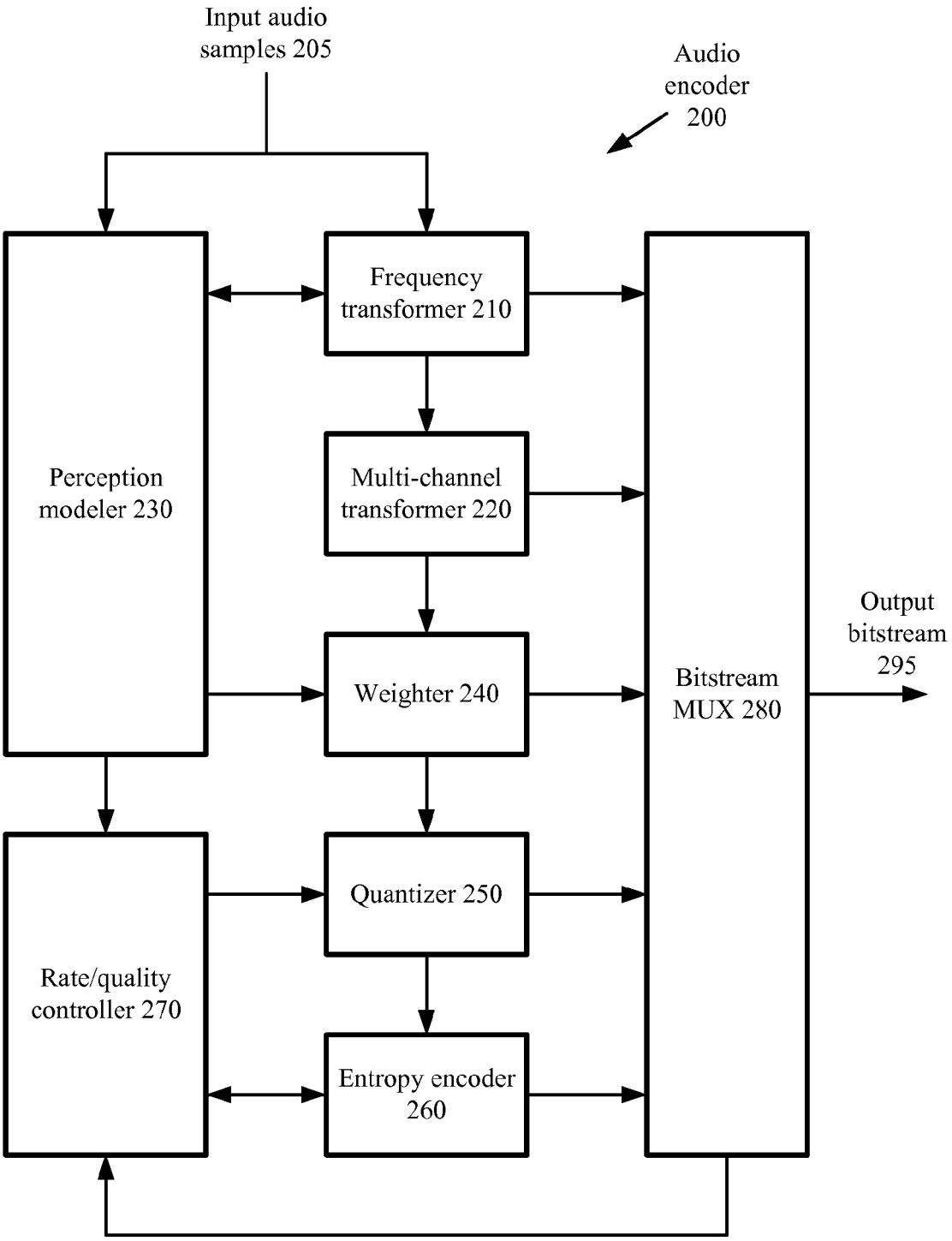
FIGS. 2, 3, 4, and 5 are block diagrams of generalized encoders and/or decoders in conjunction with which various described embodiments may be implemented.
Figure 3:
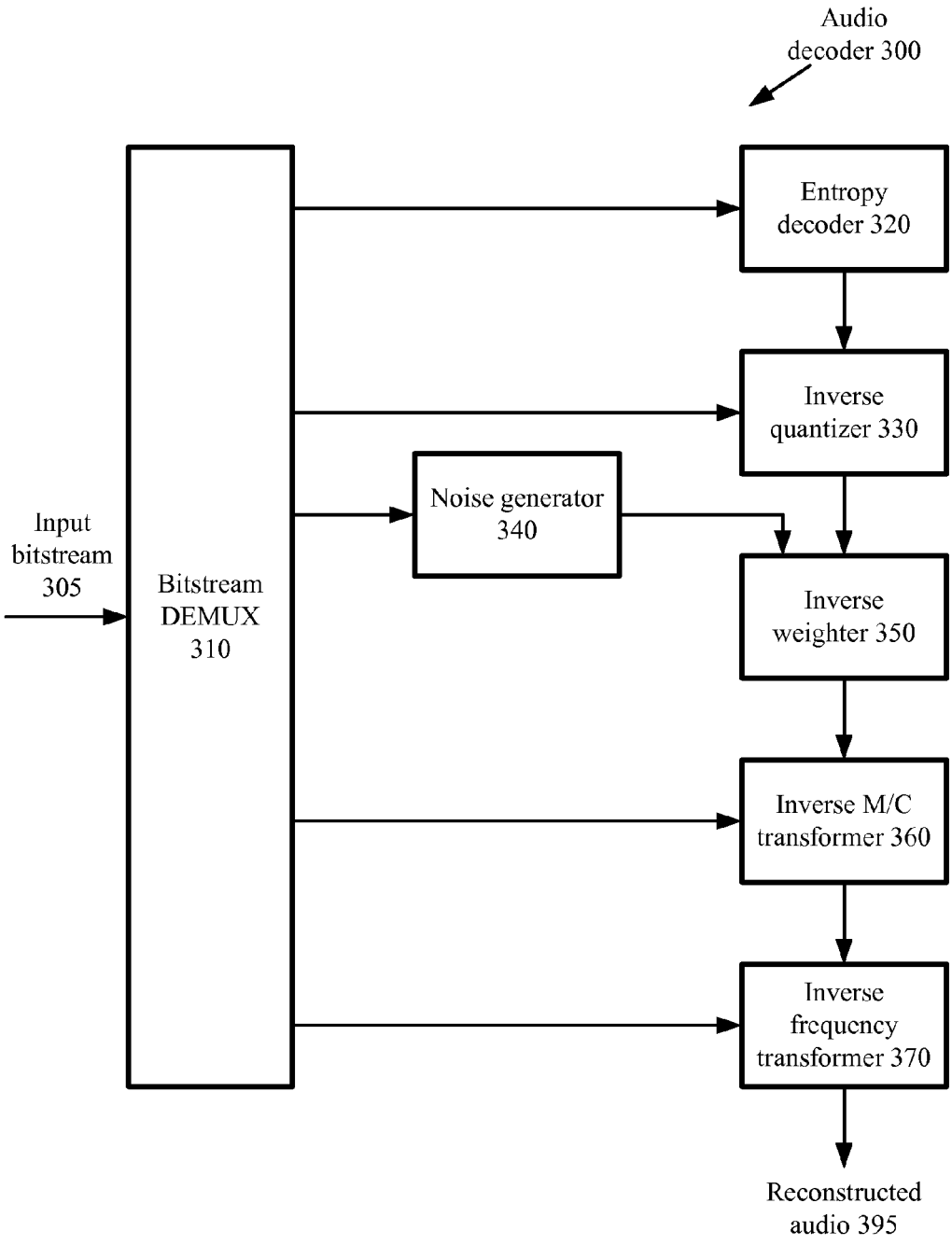

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
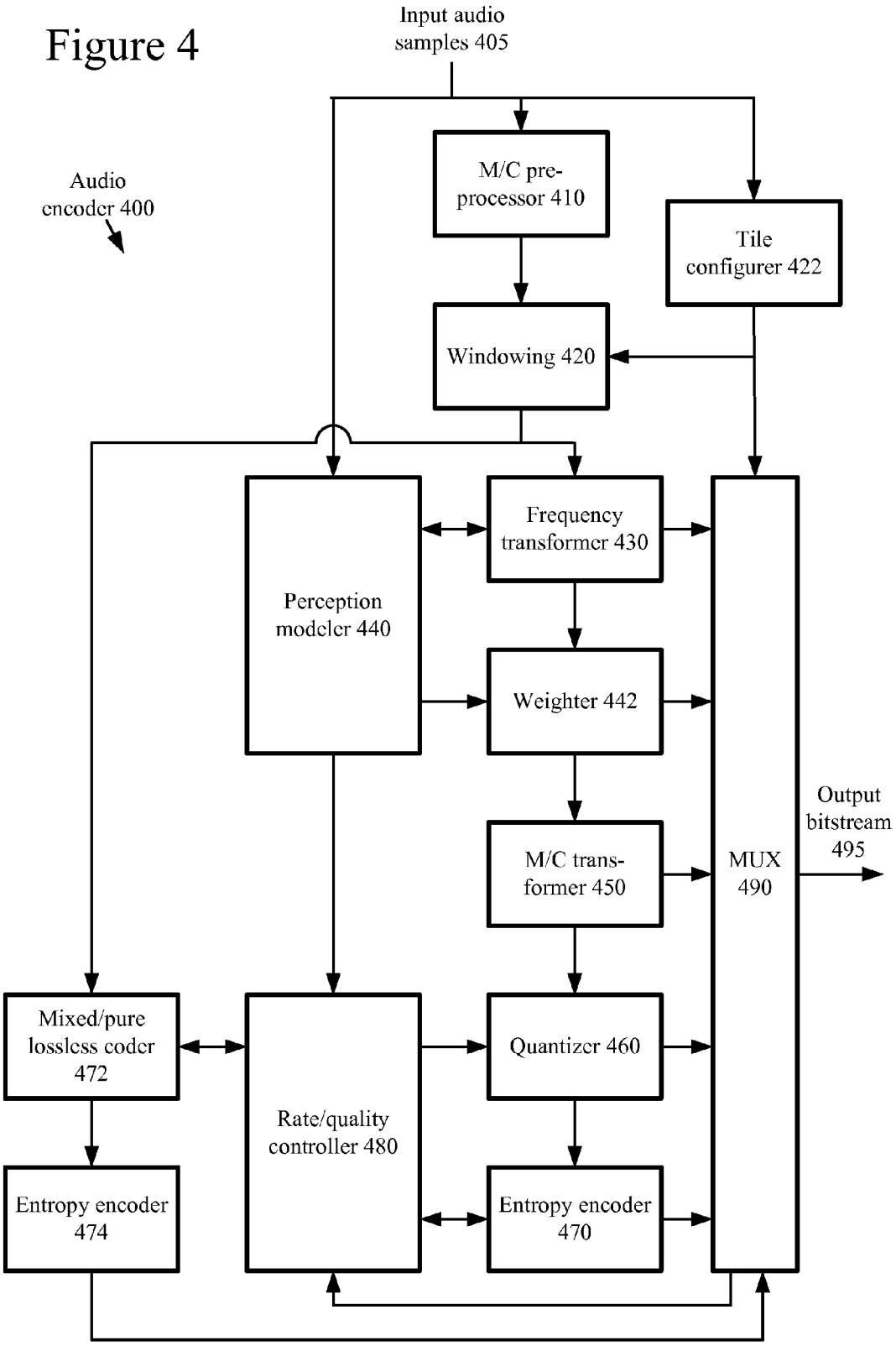
Figure 5:
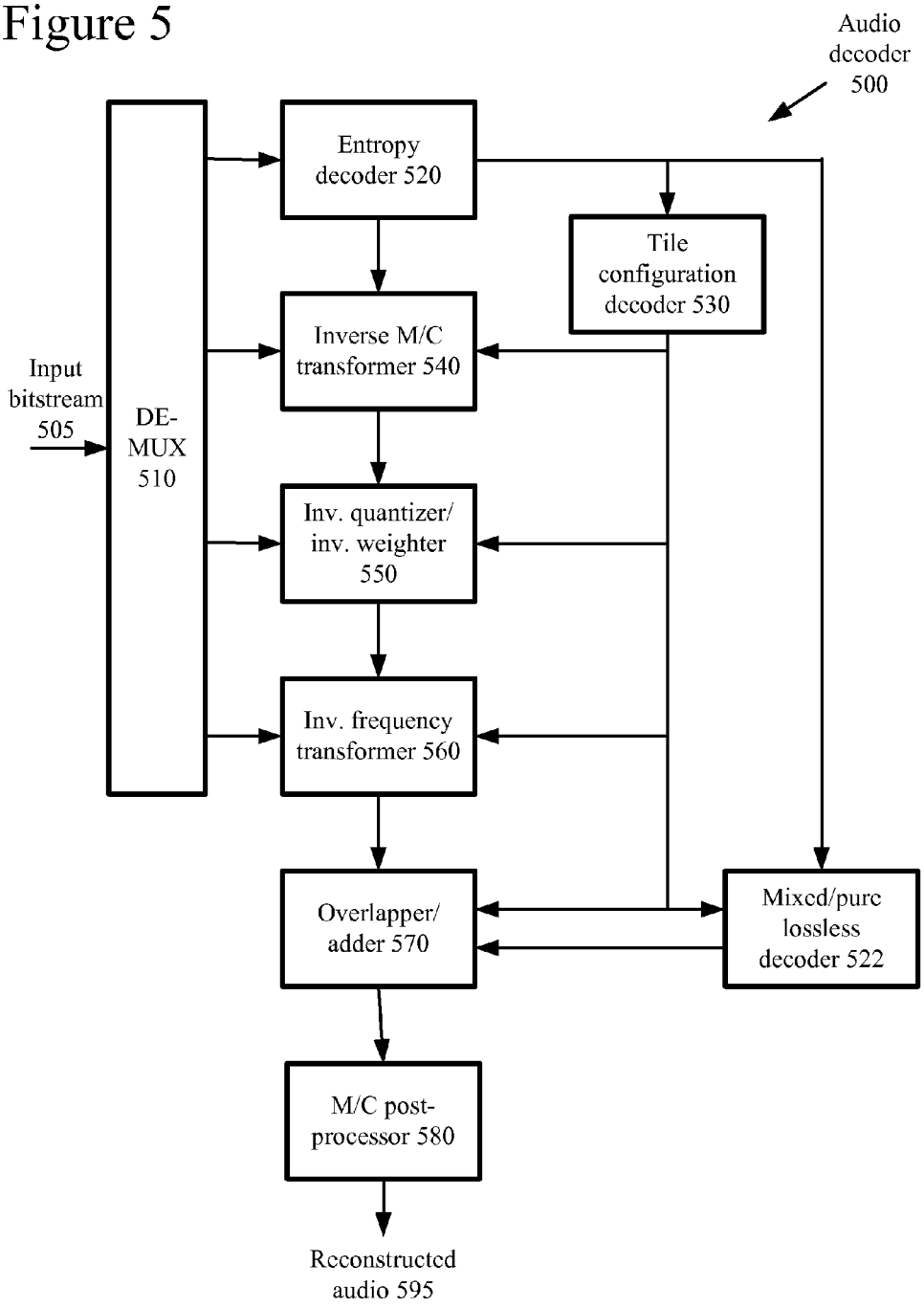

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems.

In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bitrate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bitrate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bitrate and/or quality of the output of the encoder 200. The controller 270 outputs the quantization step size to the quantizer 250 with the goal of satisfying bitrate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bitrate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bitrate) compression. The lossy coding mode includes components such as the weighter 442 and quantizer 460 and is typically used for adjustable quality (and controlled bitrate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bitrate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

Figure 6:
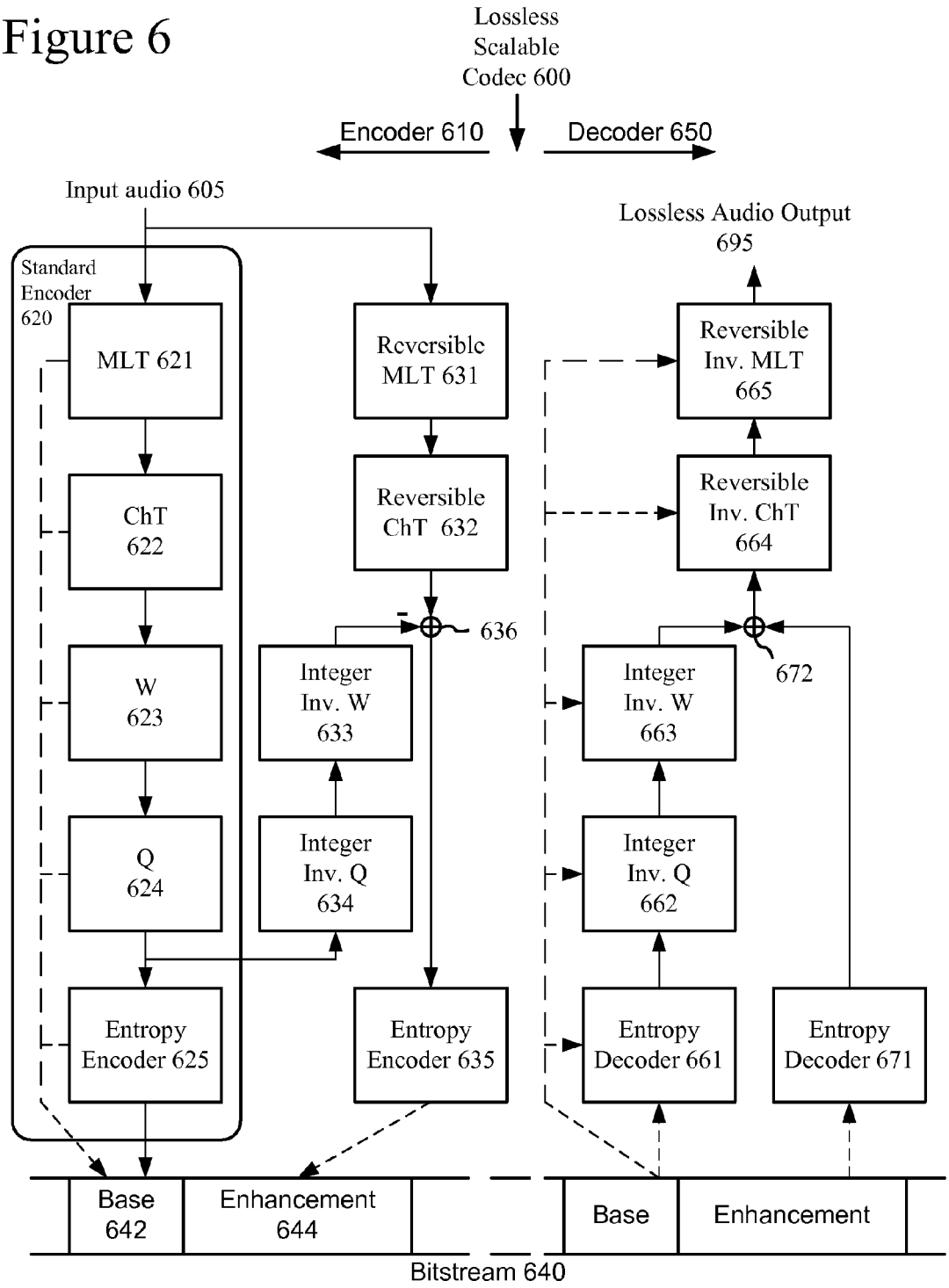
FIG. 6 is a block diagram of a lossless scalable codec using a perceptual and channel transform coding base layer and residual layer computed with a reversible weighting scheme.

FIG. 6 shows an example tile configuration 600 for a frame of 5.1 channel audio. The tile configuration 600 includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown, a particular tile can include windows in non-contiguous channels.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bitrate and/or quality of the output of the encoder 400. The controller 480 outputs the quantization factors to the quantizer 460 with the goal of satisfying quality and/or bitrate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bitrate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Residual Coding for Scalable Bit Rate

FIGS. 6-9 depict various implementations of lossless and near-losses versions of a scalable audio codec using residual coding. With residual coding, the encoder first encodes the input audio at a low bit rate. The encoder packs the low bit rate encoding into a base layer of the compressed bitstream. The encoder further at least partially reconstructs the audio signal from this base layer, and computes a residual or difference of the reconstructed audio from the input audio. The encoder then encodes this residual into an enhancement layer of the compressed bitstream.

More generally, the encoder performs the base coding as a series of N operations to create the encoded coefficients. This can be represented as the following relation, where X is the input audio, $f_i$ for i=0, 1, . . . N−1 are the base coding operations, and Y is the encoded bits of the base layer bitstream:

$$Y=f_{N-1}(f_{N-2}(\ldots f_0(X)))$$

Each f in the relation is an operator, such as the linear time-to-frequency transform, channel transform, weighting and quantization operators of the perceptual transform coding encoder described above. Some of the operators may be reversible (such as reversible linear transforms), while other base coding operations like quantization are non-reversible.

A partial forward transformation can be defined as:

$$Y_{M-1}=f_{M-1}(f_{M-2}(\ldots f_0(X)))$$

The partial reconstruction by the encoder can then be represented as the relation:

$$\hat{Y}_{M-1}=f_M^{-1}(f_{M+1}^{-1}(\ldots f_{N-1}^{-1}(Y)))$$

Then, the residual is calculated as:

$$R_{M-1}=Y_{M-1}-\hat{Y}_{M-1}=f_{M-1}(f_{M-2}(\ldots f_0(X)))-f_M^{-1}(f_{M+1}^{-1}(\ldots f_{N-1}^{-1}(f_{N-1}(f_{N-2}(\ldots f_0(X))))))$$

This relation represents that N forward transforms are applied on the input audio X, so that the base layer is coded. The base is partially reconstructed using N-M inverse transforms. The residual is then computed by performing M forward transforms on the input audio X, and taking the difference of the partially reconstructed base coding from the partial forward transform input audio.

In the residual calculation, it is not necessary to have the partial forward transform be the same operations as are used for the base coding. For example, a separate set of forward operators g can be substituted, yielding the residual calculation:

$$R_{M-1}=Y_{M-1}-\hat{Y}_{M-1}=g_{M-1}(g_{M-2}(\ldots g_0(X)))-f_M^{-1}(f_{M+1}^{-1}(\ldots f_{N-1}^{-1}(f_{N-1}(f_{N-2}(\ldots f_0(X))))))$$

At the decoder, the reconstruction for the output audio from the base layer and enhancement layer can be accomplishing by the relation:

$$\hat{X}=g_0^{-1}(g_1^{-1}(\ldots g_{M-1}^{-1}(R_{M-1}+f_M^{-1}(f_{M+1}^{-1}(\ldots f_{N-1}^{-1}(Y))))))$$

For a lossless reconstruction by the decoder, all the operations (g) have to be reversible. Further, the inverse operation $f^{l}$ should all be done using integer math, so as to produce a consistent reconstruction. The total number of inverse operations remains N.

In some residual coding variations, the residual ($R_{M-1}$) can be further transformed to achieve better compression. However, this adds additional complexity at the decoder because additional inverse operations have to be done to decode the compressed bitstream. The decoder's audio reconstruction becomes:

$$\hat{X}=g_0^{-1}(g_1^{-1}(\ldots g_{M-1}^{-1}(h^{-1}R_{M-1}+ f_M^{-1}(f_{M+1}^{-1}(\ldots f_{N-1}^{-1}(Y)))))).$$

where h can be any number of operations done to invert the forward transformation of the residual.

This principle is applied in the lossless scalable codecs shown in FIGS. 6-7 and described more fully below. For these example scalable codecs to achieve a lossless coding, it is necessary that the scalable codec employs either a reversible weighting or computes the residual in the non-channel transformed domain. The example scalable codec 700 shown in FIG. 7 computes the residual in the non-channel transformed domain. Then, because the channel transformation provides a significant reduction in coded bits, the residual is channel transformed using a reversible forward channel transform after computation of the residual. This also results in one additional channel transform step in the reconstruction.

In some variations of the scalable audio codec, the residual ($R_{M-1}$) also can be further recursively residual coded, similar to the residual coding of the input audio (X). In other words, the residual is broken into a base and another residual layer. In a simple case, the residual is simply broken up into a sum of other components without any linear transforms. That is, $$R_{M-1}=R_{M-1,0}+R_{M-1,1}+\ldots+R_{M-1,L-1}$$

One illustrative example of this is where $R_{M-1,0}$ is the most significant bit of the residual, on up to $R_{M-1,L-1}$ being the residual's least significant bit. In an alternative example, the residual can also be broken up by coefficient index, so that essentially each residual is just carrying one bit of information. This becomes a bit-plane coding of the residual. In yet further alternatives, the residual can be broken in other ways into subcomponents.

This recursive residual coding enables fast conversion (or trans-coding) of the scalable bitstream to bitstreams having various other bit rates (generally bit rates lower than that of the combined, scalable bitstream). The conversion of the scalable bitstream to either the base bitstream or some linear combination of the base layer plus one or more residual layers is possible by simply extracting bits used to encode the base layer and the desired number of residuals. For example, if the scalable bitstream has a single residual coded in its enhancement layer, the base layer can be extracted easily to create a lower bit rate stream (at the bit rate of the base alone. If the residual is coded using bit-plane coding (with each residual carrying a single bit of information), then the transcoder can extract a bitstream at all bit rates between that of the base coding and the full bit-rate audio.

Figure 8:
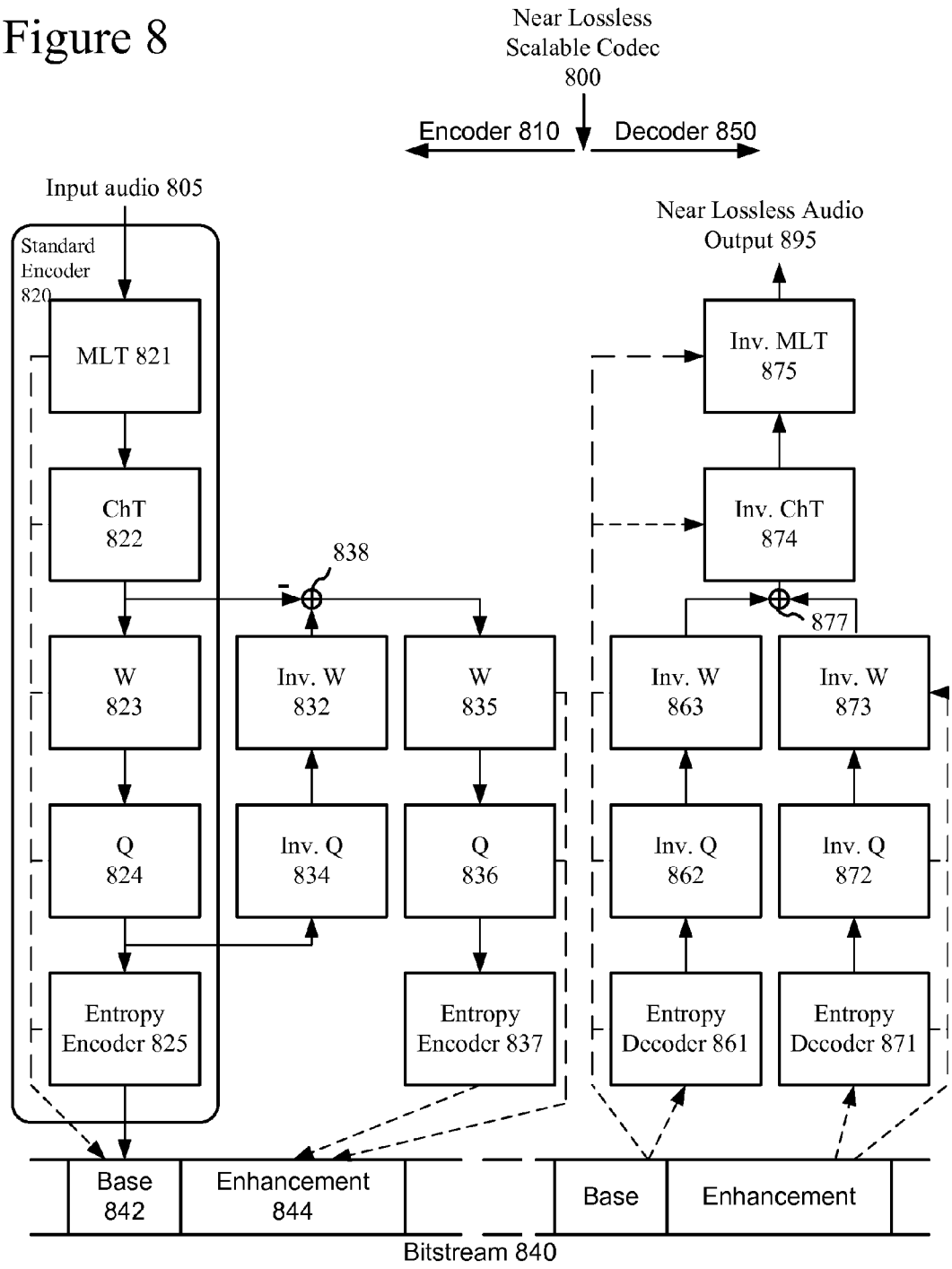
FIG. 8 is a block diagram of a near lossless scalable codec using a perceptual and channel transform coding base layer and residual layer computed with a reversible weighting scheme.
Figure 9:
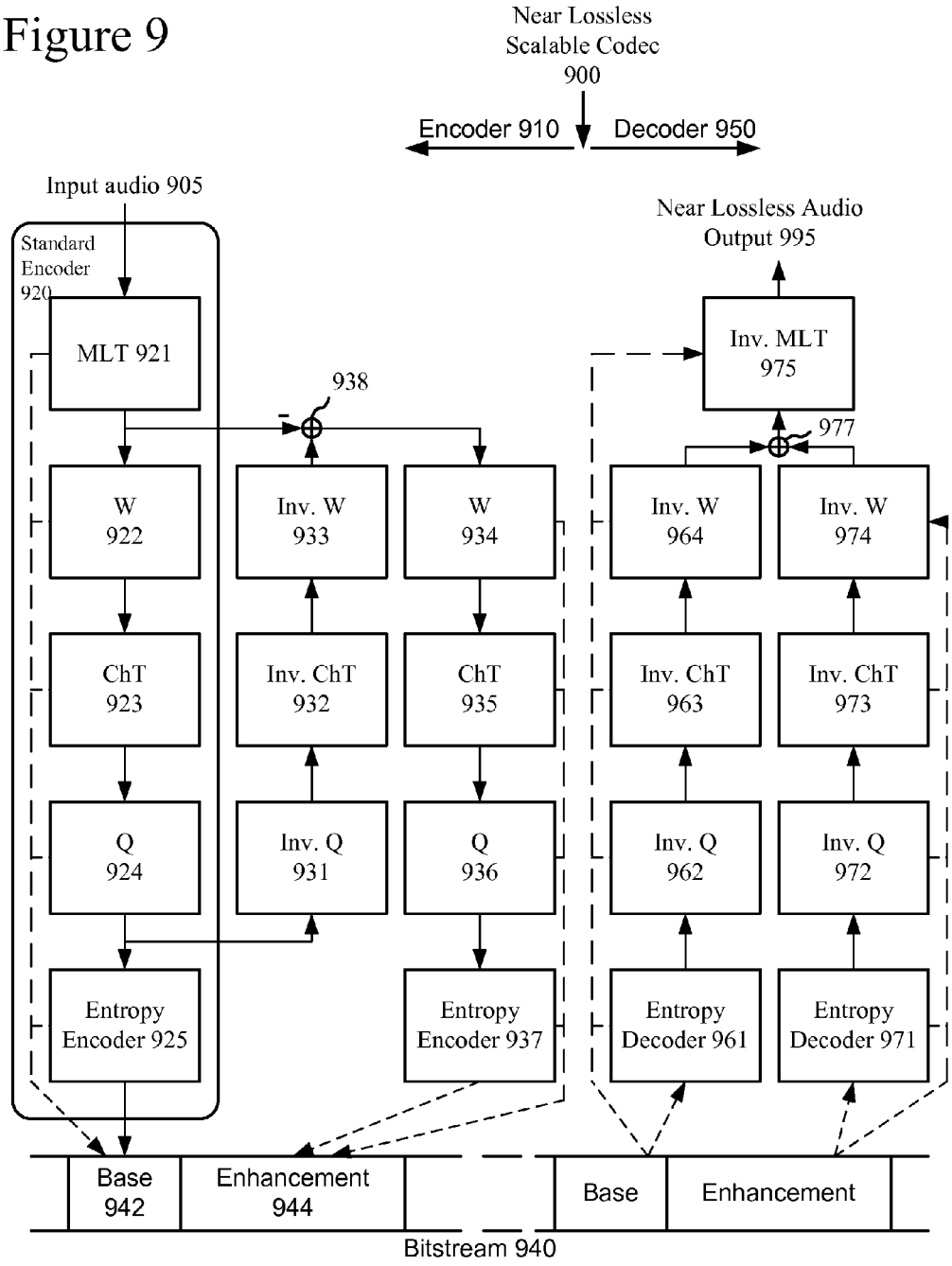
FIG. 9 is a block diagram of a near lossless scalable codec using a perceptual and channel transform coding base layer and residual layer computed in non-channel transformed domain.

The previous examples also include near lossless scalable codecs shown in FIGS. 8-9.

Because reversible transforms have fairly high complexity, a lower complexity reconstruction that is approximately lossless can be achieved using low complexity non-reversible operations that have results close to those of the reversible operations. For example, the reversible inverse Modulated Lapped Transform (MLT) and reversible inverse channel transforms of the lossless examples shown in FIGS. 6-7 are simply replaced with non-reversible approximations.

III. Example Scalable Codecs

With reference now to FIG. 6, an example lossless version scalable codec 600 includes an encoder 610 for encoding input audio 605 as a compressed bitstream 640, and a decoder 650 for decoding the compressed bitstream so as to reconstruct a lossless audio output 695. The encoder 610 and decoder 650 typically are embodied as separate devices: the encoder as a device for authoring, recording or mastering an audio recording, and the decoder in an audio playback device (such as, a personal computer, portable audio player, and other audio/video player devices).

The encoder 610 includes a high compression rate encoder 620 that uses a standard perceptual transform coding (such as the audio encoder 200, 400 shown in FIGS. 2 and 4 and described above) to produce a compressed representation of the input audio 605. The high compression rate encoder 620 encodes this compressed audio as a base layer 642 of the compressed bitstream 640. The encoder 620 also may encode various encoding parameters and other side information that may be useful at decoding into the base layer 642.

As with the generalized audio encoders 200, 400 shown in FIGS. 2 and 4 and described in more detail above, one illustrated example of the high compression rate encoder 620 includes a frequency transformer (e.g., a Modulated Lapped Transform or MLT) 621, a multi-channel transformer 622, a weighter 623, a quantizer 624 and an entropy encoder 625, which process the input audio 605 to produce the compressed audio of the base layer 642.

The encoder 610 also includes processing blocks for producing and encoding a residual (or difference of the compressed audio in the base layer 642 from the input audio 610). In this example scalable codec, the residual is calculated with a frequency and channel transformed versions of the input audio. For a lossless reconstruction at decoding, it is necessary that the frequency transformer and multi-channel transformer applied to the input audio in the residual calculation path are reversible operations. Further, the partial reconstruction of the compressed audio is done using integer math so as to have a consistent reconstruction. Accordingly, the input audio is transformed by a reversible Modulated Lapped Transform (MLT) 631 and reversible multi-channel transform 632, while the compressed audio of the base layer is partially reconstructed by an integer inverse quantizer 634 and integer inverse weighter 633. The residual then is calculated by taking a difference 636 of the partially reconstructed compressed audio from the frequency and channel transformed version of the input audio. The residual is encoded by an entropy encoder 635 into the enhancement layer 644 of the bitstream 640.

The lossless decoder 650 of the first example scalable codec 600 includes an entropy decoder 661 for decoding the compressed audio from the base layer of the compressed bitstream 640. After entropy decoding, the decoder 650 applies an integer inverse quantizer 662 and integer inverse weighter 663 (which match the integer inverse quantizer 634 and inverse integer weighter 633 used for calculating the residual). The lossless decoder 650 also has an entropy decoder 671 for decoding the residual from the enhancement layer of the compressed bitstream 640. The lossless decoder combines the residual and partially reconstructed compressed audio in a summer 672. A lossless audio output is then fully reconstructed from the sum of the partially reconstructed base compressed audio and the residual using a reversible inverse multi-channel transformer 664 and reversible inverse MLT 665.

In a variation of the lossless scalable codec 600, the encoder 610 can perform a lossless encoding of the input audio by using reversible version MLT and multi-channel transforms in the residual calculation, while the decoder 650 uses a low-complexity non-reversible version of these transforms—by replacing the transforms 664 and 665 with non-reversible version of these transforms. Such variation is appropriate to scenarios where the audio player (decoder) is a low complexity device, such as for portability, while the encoder can be full complexity audio master recording equipment. In such a scenario, we can also replace operations 662 and 663 by non-integer operations if the device has floating point processing to improve speed as well. The operations 662, 663, 664 and 665 can be replaced by operations 862, 863, 874 and 875 (FIG. 8) respectively, which are all lower in complexity.

Figure 7:
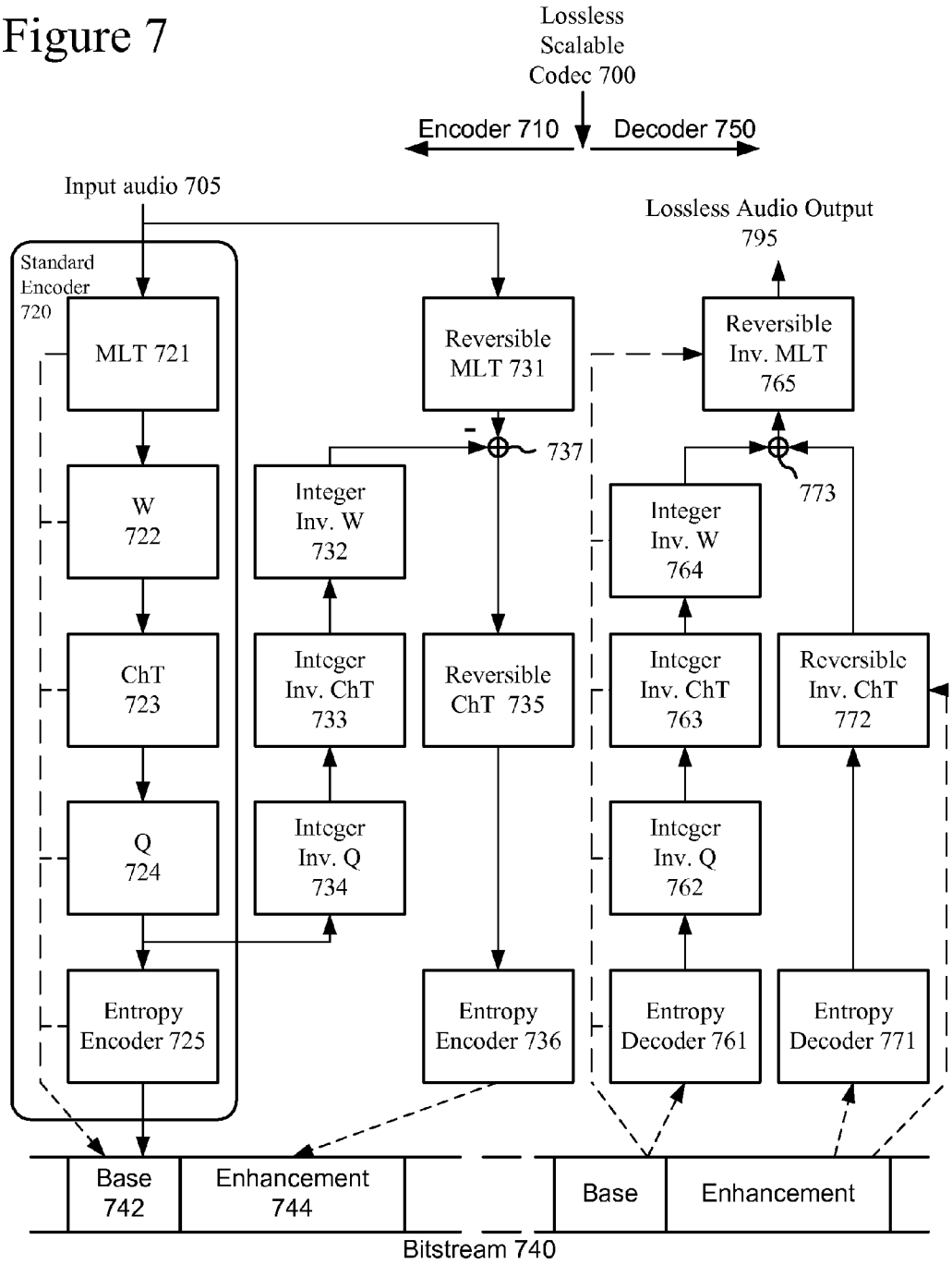
FIG. 7 is a block diagram of a lossless scalable codec using a perceptual and channel transform coding base layer and residual layer computed in non-channel transformed domain.

FIG. 7 shows an alternative example lossless scalable codec 700, where the residual is calculated in the non-channel transformed domain. The scalable encoder 710 includes a standard encoder 720 for encoding the base layer 742 of the compressed bitstream 740. The base layer encoder 720 can be the type of audio encoder shown in FIGS. 2 and 4 and described above, which encodes the input audio at a high compression rate using perceptual transform coding by applying an MLT frequency transform 721, weighter 722, multi-channel transform 723, quantizer 724, and entropy encoder 725.

In this alternative lossless scalable codec example, the encoder 710 calculates the residual in the non-channel transformed domain. Again, to achieve a lossless codec, the frequency transform and multi-channel transform applied to the input audio for the residual calculation must be reversible. For a consistent reconstruction, the encoder uses integer math. Accordingly, the encoder partially reconstructs the compressed audio of the base layer using an integer inverse quantizer 734, integer inverse multi-channel transform 733 and integer inverse weighter 732. The encoder also applies a reversible MLT 731 to the input audio. The residual is calculated from taking a difference 737 of the partially reconstructed compressed audio from frequency transformed input audio. Because the channel transform significantly reduces the coded bits, the encoder also uses a reversible multi-channel transform 735 on the residual.

At the decoder 750 of the lossless scalable codec 700, the compressed audio of the base layer of the compressed bitstream is partially reconstructed by an entropy decoder 761, integer inverse quantizer 762, integer inverse channel transformer 763 and reversible inverse weighter 764. The decoder also decodes the residual from the enhancement layer via an entropy decoder 771 and reversible inverse multi-channel transform 772. Because the residual also was multi-channel transformed, the decoder includes this additional inverse channel transform step to reconstruct the residual. The decoder has a summer 773 to sum the partially reconstructed compressed audio of the base layer with the residual. The decoder then applies a reversible inverse MLT 765 to produce a lossless audio output 795.

A first example near lossless scalable codec 800 shown in FIG. 8 is similar to the example lossless scalable codec 600. However, for near lossless reconstruction, the frequency transformer and multi-channel transformer are not required to be reversible. In the illustrated example near lossless scalable codec 800, the non-reversible MLT 821 and multi-channel transformer 822 of the standard encoder 820 also are used for the residual calculation path. A partial reconstruction of the compressed audio of the base layer is performed by an inverse weighter 832 and inverse quantizer 834. The residual is calculated by taking a difference 838 of the partially reconstructed compressed audio of the base layer from the input audio after the MLT 821 and multi-channel transform 822 are applied. The calculated residual is then encoded by a separate weighter 835 quantizer 836, and entropy encoder 837. The weighter 823, 835 are not necessarily identical. To better serve with the residual, the perceptual modeling in weighter 835 could be derived from a different one used in the base layer.

At a decoder 850 of the near lossless scalable codec 800, the compressed audio from the base layer and the residual from the enhancement layer are each partially reconstructed by respective entropy decoders (861, 871), inverse quantizers (862, 872), and inverse weighters (863, 873). The partially reconstructed base audio and residual are summed by a summer 877. The decoder then finishes reconstructing a near lossless audio output 895 by applying an inverse multi-channel transform 874 and inverse MLT 875. The inverse multi-channel transform 874 and inverse MLT 875 are low complexity, non-reversible versions of the transforms.

FIG. 9 illustrates another example of a near lossless scalable codec 900. In this example, similar to the lossless scalable codec 700 of FIG. 7, the residual is calculated in the non-channel transformed domain. The example codec 900 has an encoder 910 that includes a base layer encoder 920 for encoding a compressed audio into a base layer of a compressed bitstream 940 using perceptual transform coding. The base layer encoder 920 includes an MLT 921, weighter 922, multi-channel transformer 923, quantizer 924, and entropy encoder 925. In its residual calculation, the encoder 910 of this example codec 900 subtracts (938) a partial reconstruction by an inverse quantizer 931, inverse multi-channel transformer 932, and inverse weighter 933 of the compressed audio of the base layer from the frequency transformed input audio (i.e., the input audio after its frequency transform by the MLT 921 in the base layer encoder 920) to produce the residual. The residual is encoded by a separate weighter 934, multi-channel transformer 935, quantizer 936 and entropy encoder 937 into an enhancement layer of the compressed bitstream. To improve the coding gain of the residual, the weighter 934 and channel transformer 935 can be different from the weighter 922 and channel transformer 923 in the base layer encoder 920.

For a near lossless reconstruction, a decoder 950 for the example near lossless scalable codec 900 performs a partial reconstruction of the compressed audio from the base layer and residual from the enhancement layer via respective entropy decoders (961, 971), inverse quantizers (962, 972), inverse multi-channel transformers (963, 973) and inverse weighters (964, 974). The decoder 950 then finishes reconstruction by summing (977) the partially reconstructed base layer audio and residual, and applying an inverse MLT 975 to produce a near lossless audio output. For purposes of reducing complexity, if the weighting and channel transform of the base and the residual are the same, the decoder 950 can do the summation earlier (before inverse weighting and/or inverse channel transform).

In each of the example scalable codecs 600, 700, 800 and 900, the decoder also can produce a lower quality reconstruction by simply decoding the compressed audio of the base layer (without reconstructing and adding the residual). In variations of these codecs, multiple recursive residual coding can be performed at the encoder. This enables the decoder to scale the quality and compression ratio at which the audio is reconstructed by reconstructing the base audio and an appropriate number of the coded residuals. Likewise, a transcoder can recode the compressed bitstream produced by these codecs to various compression rates by extracting the base layer and any corresponding residuals for the target compression rate, and repacking them into a transcoded bitstream.

In view of the many possible embodiments to which the principles of our invention may be applied, we claim as our invention all such embodiments as may come within the scope and spirit of the following claims and equivalents thereto.

We claim:

1. A method of scalable audio encoding, comprising:

processing an input audio signal using perceptual transform coding to produce a base compressed audio substream;

partially reconstructing compressed audio from the base compressed audio substream to a transform domain;

processing the input audio signal using at least one transform into a transformed audio in the transform domain;

taking a difference between the partially reconstructed compressed audio and the transformed audio to produce an audio residual;

coding the audio residual into an enhancement audio substream; and packing the base compressed audio substream and the enhancement audio substream into a compressed audio bitstream.

2. The method of claim 1, wherein the at least one transform comprises a frequency transform.

3. The method of claim 2, wherein the frequency transform is a modulated lapped transform.

4. The method of claim 2, wherein the frequency transform is reversible and the compressed audio bitstream permits a lossless reconstruction of the input audio signal.

5. The method of claim 2, wherein the at least one transform further comprises a multi-channel transform.

6. The method of claim 5, wherein the frequency transform and the multi-channel transform are each reversible and the compressed audio bitstream permits a lossless reconstruction of the input audio signal.

7. A method of decoding a scalable audio compressed bitstream having a base layer and an enhancement layer, the method comprising:

performing entropy decoding of a base audio from the base layer and a residual audio from the enhancement layer of the scalable audio compressed bitstream;

partially reconstructing the base audio to a transform domain representation;

combining the base audio and residual audio;

processing the combined base and residual audio using at least one inverse transform to complete reconstruction of an output audio signal; and producing the output audio signal.

8. The method of claim 7 wherein the at least one inverse transform comprises an inverse frequency transform.

9. The method of claim 8 wherein the inverse frequency transform is an inverse modulated lapped transform.

10. The method of claim 8 wherein the at least one inverse transform further comprises an inverse multi-channel transform.

11. The method of claim 10 wherein the inverse frequency transform and the inverse multi-channel transform are reversible transforms.

12. The method of claim 8 further comprising:

processing the residual audio using an inverse channel transform prior to said combining.

13. The method of claim 12 wherein the inverse multi-channel transform is a reversible transform.

14. A scalable audio decoder, comprising:

an input for receiving a compressed audio bitstream containing a compressed audio base layer and at least one residual enhancement layer;

a first entropy decoder for decoding a base audio from the compressed audio base layer of the compressed audio bitstream;

a second entropy decoder for decoding a residual from the at least one residual enhancement layer of the compressed audio bitstream;

a partial reconstructor for applying at least one inverse perceptual transform coding process to partially reconstruct the base audio to a transform domain representation;

a summer for summing the base audio and residual in the transform domain; and an inverse transformer for applying at least one inverse transform to the summed base audio and residual to produce a reconstructed audio signal in the time domain; and an audio output for output of the reconstructed audio signal.

15. The scalable audio decoder of claim 14 wherein the at least one inverse transform comprises an inverse frequency transform.

16. The scalable audio decoder of claim 15 wherein the inverse frequency transform is an inverse modulated lapped transform.

17. The scalable audio decoder of claim 15 wherein the at least one inverse transform further comprises an inverse multi-channel transform.

18. The scalable audio decoder of claim 15 wherein the inverse frequency transform and the inverse multi-channel transform are reversible.

19. The scalable audio decoder of claim 14 further comprising:

an inverse multi-channel transformer for performing an inverse multi-channel transform of the residual prior to summing with the base audio by said summer.

* * * * *